US007625179B2

(12) United States Patent
Cunha et al.

(10) Patent No.: US 7,625,179 B2
(45) Date of Patent: Dec. 1, 2009

(54) AIRFOIL THERMAL MANAGEMENT WITH MICROCIRCUIT COOLING

(75) Inventors: Francisco J. Cunha, Avon, CT (US); Matthew T. Dahmer, Auburn, MA (US)

(73) Assignee: United Technologies Corporation, Hartford, CT (US)

( * ) Notice: Subject to any disclaimer, the term of this patent is extended or adjusted under 35 U.S.C. 154(b) by 417 days.

(21) Appl. No.: 11/520,374

(22) Filed: Sep. 13, 2006

(65) Prior Publication Data

US 2009/0238675 A1 Sep. 24, 2009

(51) Int. Cl.
*F01D 5/18* (2006.01)

(52) U.S. Cl. ..... 416/97 R

(58) Field of Classification Search ..... 416/233, 416/97 R

See application file for complete search history.

(56) References Cited

U.S. PATENT DOCUMENTS 6,514,042 B2 * 2/2003 Kvasnak et al. ..... 416/97 R
6,533,547 B2 * 3/2003 Anding et al. ..... 416/97 R
6,773,230 B2 * 8/2004 Bather et al. ..... 416/97 R
7,303,376 B2 * 12/2007 Liang ..... 416/97 R
7,322,795 B2 * 1/2008 Luczak et al. ..... 416/97 R
7,481,622 B1 * 1/2009 Liang ..... 416/97 R
7,527,474 B1 * 5/2009 Liang ..... 416/97 R

* cited by examiner

*Primary Examiner*—Richard Edgar
(74) *Attorney, Agent, or Firm*—Bachman & LaPointe, P.C.

(57) ABSTRACT

A turbine engine component, such as a turbine engine blade, has an airfoil portion with a pressure side wall and a suction side wall, a plurality of ribs extending between the pressure side wall and the suction side wall, and a plurality of supply cavities located between the ribs. The component further has an arrangement for cooling the airfoil portion. The cooling arrangement comprises a first cooling circuit embedded within the suction side wall for convectively cooling the suction side wall, a second cooling circuit embedded within the pressure side wall for cooling the pressure side wall, and a third passageway for increasing a temperature of at least one of the ribs by conduction.

17 Claims, 2 Drawing Sheets

AIRFOIL THERMAL MANAGEMENT WITH MICROCIRCUIT COOLING

BACKGROUND OF THE INVENTION (1) Field of the Invention

The present invention relates to a cooling arrangement for use in a turbine engine component.

(2) Prior Art

FIG. 1 illustrates a current cooling scheme for a turbine blade 10. It consists of a hybrid application of embedded microcircuit panels 12 running axially along the airfoil walls 14 and 16 in combination with a set of film cooling holes. The airfoil active convective cooling is done through a series of microcircuits 12 in the mid-body and trailing edge portions of the airfoil 18, supplemented with film cooling by a series of film holes 20. There are two considerations with this blade that could be improved upon. First, the axial circuits do not take full advantage of pumping; therefore, dedicated feed cavities are used for independently feeding each circuit. This leads to an increased number of airfoil ribs 22. Second, as a result, the ribs 22 are relatively cold when compared with the outer layers of the airfoil walls.

As the blade 10 ramps up in load, the airfoil outer layers experience relatively hot metal temperatures. If the temperature is sufficiently high, a stress relaxation process occurs at these airfoil locations, leading to relatively high strains (deformations). Simultaneously, the relative cold inside ribs 22 experience an increase in stress as the load to the part needs to be shared by the entire airfoil 18. This balance in the stress-state of the airfoil occurs every time a blade is ramped up, causing some amount of irreversible damage, which, in excessive limits, can lead to catastrophic failures. If these limits are not approached, the amount of damage accumulation can take some time or cycles. That is, long enough to make the design viable for the require life targets. Two modes of failure exists: (a) creep; and (b) fatigue. Oxidation also occurs, but is not discussed as it can be incorporated in creep damage due to the reduced load-bearing capability from metal-oxide attack. The creep damage is related to blade temperature; but fatigue is related to temperature differences in the blade, in particular, the outer relative hot airfoil layers and cold internal ribs. It is therefore desirable to reduce the outer metal temperatures, and the thermal gradients in the part.

SUMMARY OF THE INVENTION

The present invention relates to a cooling scheme for a turbine engine component, such as a turbine blade, which reduces the outer metal temperatures and the thermal gradients in the part.

In accordance with the present invention, a turbine engine component is provided which broadly comprises an airfoil portion having a pressure side wall and a suction side wall, a plurality of ribs extending between said pressure side wall and said suction side wall, and a plurality of supply cavities located between said ribs; and an arrangement for cooling said airfoil portion comprising a first means embedded within said suction side wall for convectively cooling said suction side wall, a second means embedded within said pressure side wall for cooling said pressure side wall, and third means for increasing a temperature of at least one said ribs by conduction.

Further in accordance with the present invention, there is a provided a process for cooling a turbine engine component broadly comprising the steps of:

providing a first cooling circuit in a suction side of an airfoil portion of said turbine engine component; providing a second cooling circuit in a pressure side of said airfoil portion; convectively cooling said suction side of said airfoil portion with said first cooling circuit; and heating a rib within said airfoil portion using cooling fluid leaving said first cooling circuit.

Other details of the airfoil thermal management with microcircuit cooling of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
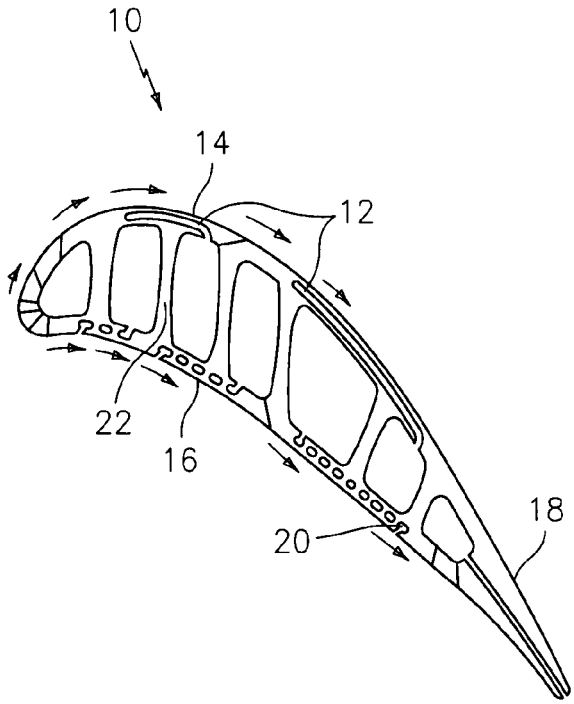
FIG. 1 (PRIOR ART)
FIG. 1 is a schematic representation of a turbine blade having a current cooling scheme.
Figure 2:
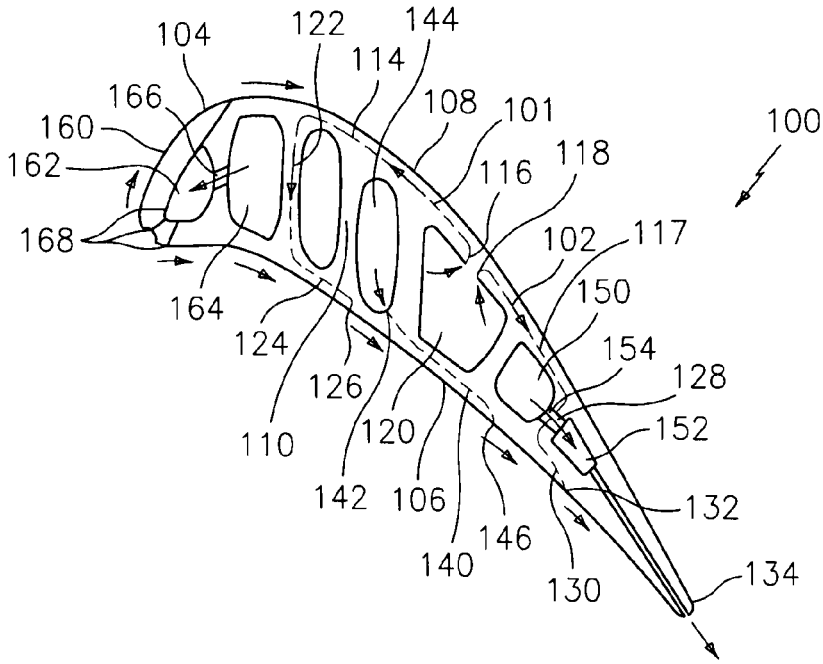
FIG. 2 is a schematic representation of a turbine engine component having a cooling scheme in accordance with the present invention.

Referring now to FIG. 2, there is shown a turbine engine component 100, such as a turbine blade, with a different set of microcircuits 101 and 102 embedded in the walls and ribs of the airfoil portion 104. As can be seen from FIG. 2, the airfoil portion 104 includes a pressure side wall 106 and a suction side wall 108. The airfoil portion 104 also includes a plurality of ribs 110. To reduce the outer layer metal temperatures, peripheral cooling with microcircuits embedded within the walls 106 and 108 is used. The cooling scheme of the present invention however takes advantage of pumping, and the thermal stress, due to large temperature differences, should be minimized.

Figure 3:
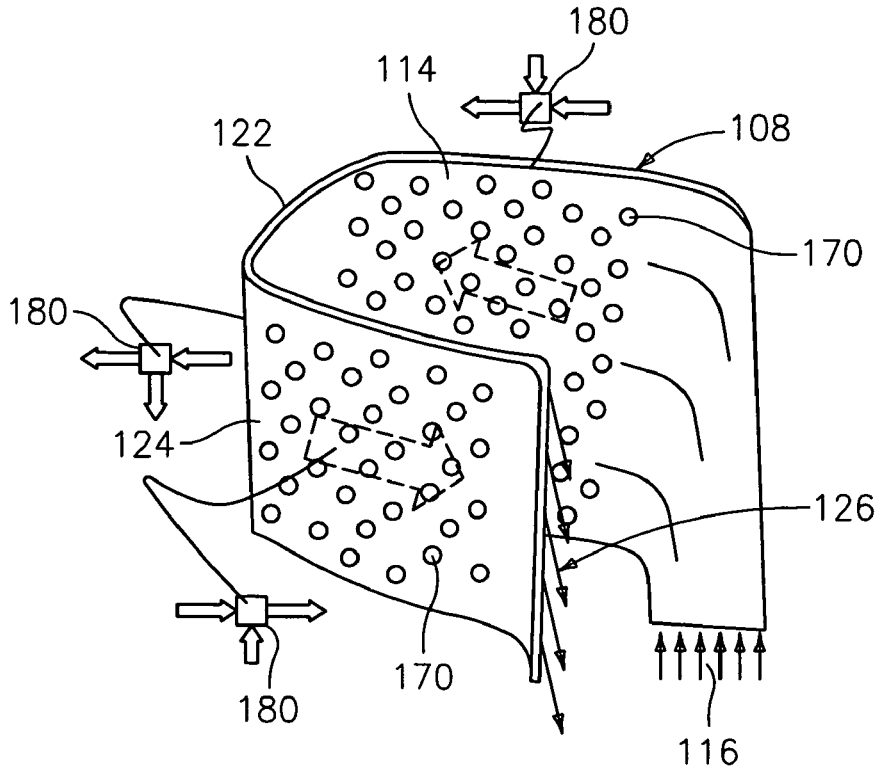
FIG. 3 is a schematic representation of a high pressure turbine engine component with cooling microcircuits starting at the suction side and ending on the pressure side.

The cooling scheme of the present invention includes suction side cooling microcircuits 101 and 102 embedded within the suction side wall 108. The circuit 101 has a flow inlet 116, while the circuit 102 has a flow inlet 118. As shown in FIG. 3, the flow inlet 116 is located at a root section of the turbine engine component 100 for pumping. The flow inlet 118 is also located at the root section of the turbine engine component 100. Each of the flow inlets 116 and 118 communicate with a source of cooling fluid, such as engine bleed air, flowing through the supply cavity 120.

As can be seen from FIG. 2, the cooling circuits 101 and 102 have no film holes which would allow cooling fluid to flow over the exterior surface of the suction side 108 of the airfoil portion 104. The suction side 108 is cooled solely by convection.

The cooling circuit 101 has a cooling circuit 114 embedded within the suction side wall 108. Cooling fluid flows from the cooling circuit 114 to the pressure side 106 of the airfoil portion 104 via one or more passageways 122 in a first of the ribs 110. Each passageway 122 connects the cooling circuit 114 with a cooling circuit 124 embedded within the pressure side wall 106. The cooling circuit 124 has one or more film cooling holes 126 which allow the cooling fluid to flow over the pressure side wall 106.

The cooling circuit 102 has a cooling circuit 117 embedded within the suction side wall 108. The cooling circuit 117 communicates with one or more passageways 128 in a second one of the ribs 110. Each passageway 128 communicates with a second cooling circuit 130 embedded in the pressure side wall 106, which circuit 130 has one or more film cooling holes 132 for allowing a film of cooling fluid to flow over a portion of the pressure side wall 106 adjacent a trailing edge 134 of the airfoil portion 104.

If desired, a third cooling circuit 140 may be embedded in the pressure side wall 106. The third cooling circuit 140 has an inlet 142 also located at the root section of the turbine engine component 100 for pumping. The inlet 142 communicates with a source of cooling fluid via the supply cavity 144. The circuit 140 also may have one or more film cooling holes 146 for allowing cooling fluid to flow over the external surface of the pressure side wall 106.

Figure 4:
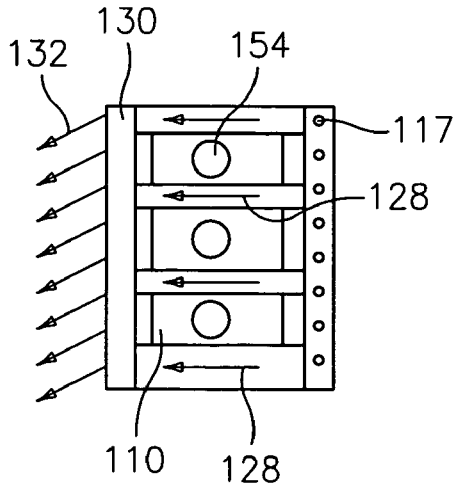
FIG. 4 is a schematic representation showing communication of suction and pressure side microcircuit legs through the ribs.

Referring now to FIGS. 2 and 4, to further cool the trailing edge 134 of the airfoil portion, cooling fluid from a cavity 150 may pass through a trailing edge cooling circuit 152 via one or more cross over holes 154 in a most rearward one of the ribs 110.

To cool a leading edge 160 of the airfoil portion 104, cooling fluid may be provided to a leading edge cooling cavity 162 from a supply cavity 164 via one or more cross over holes 166 in a most forward one of the ribs 110. The leading edge cooling cavity 162 may have one or more fluid outlets 168 in the leading edge 160 to allow cooling fluid to flow over the leading edge portion of the pressure side wall 106 and the suction side wall 108.

If desired, each of the cooling circuits embedded in the pressure and suction side walls 106 and 108 may have a plurality of pedestals 170 for enhancing heat transfer. The pedestals 170 may have any desired shape such as a cylindrical shape.

As can be seen from the foregoing discussion, the cooling scheme of the present invention has a feed which starts at the suction side of the airfoil portion 104, particularly at the root section. The flow is guided through the suction side of the airfoil, picking up heat in that section of the airfoil. In other designs, the cooling circuit in the suction side would end, also at the suction side, by allowing film cooling to eject externally out of the circuit. This has the advantage of film protection at the suction side, but also causes mixing and entropy, which affects performance negatively. In the cooling scheme of the present invention, the circuit does not end in film cooling, but proceeds through the internal ribs 110 towards the pressure side 106. The net effect of this is to increase the temperature of the ribs 110 through conduction. The third leg of the circuit is formed to transport the coolant through the pressure side wall 106 of the airfoil portion 104, discharging with film cooling at the pressure side. In FIG. 3, there is shown a series of heat balance control volumes 180 which illustrate the concept of picking-up heat at the suction side first; dissipating the heat through the rib; and picking-up heat once again at the pressure side, ending the circuit with film cooling at the pressure side.

As previously discussed, FIG. 4 illustrates details, showing communication of suction side and pressure side microcircuit legs through the ribs 110, when there are cross over holes in the ribs 110.

With the cooling scheme of the present invention, the following targets are accomplished: (1) a reduction in creep damage with peripheral microcircuit cooling; (2) an enhancement of the heat pick-up by taking advantage of a natural rotational pumping action; (3) a reduction in overall thermal gradients by increasing the internal rib temperatures; (4) an increase in the convective efficiency of the microcircuits by allowing a continued cooling capability on the opposite side of the airfoil portion; and (5) a film cooling of the pressure side with a circuit that starts at the suction side, thus eliminating aerodynamic losses in the suction side of the airfoil portion 104.

It is apparent that there has been provided in accordance with the present invention an airfoil thermal management with microcircuit cooling which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a pressure side wall and a suction side wall, a plurality of ribs extending between said pressure side wall and said suction side wall, and a plurality of supply cavities located between said ribs; and an arrangement for cooling said airfoil portion comprising a first means embedded within said suction side wall for convectively cooling said suction side wall, a second means embedded within said pressure side wall for cooling said pressure side wall, and third means for increasing a temperature of at least one of said ribs by conducting fluid through said at least one of said ribs, wherein said first means comprises a first cooling circuit embedded within said suction side wall, said second means comprises a second cooling circuit embedded within said pressure side wall, and said third means comprises at least one fluid passageway in a first one of said ribs for conducting fluid from said first cooling circuit to said second cooling circuit.

2. The turbine engine component of claim 1, wherein said first means has a fluid inlet in a root section of said turbine engine component to take advantage of pumping to increase cooling effectiveness.

3. The turbine engine component of claim 1, further comprising said second cooling circuit having at least one film cooling hole for allowing cooling fluid to flow over an external surface of said pressure side wall.

4. The turbine engine component of claim 1, wherein said first cooling circuit cools said suction side wall solely by convection and wherein said first cooling circuit has no film cooling hole for allowing cooling fluid to flow over an external surface of said suction side wall.

5. The turbine engine component of claim 1, wherein said first means comprises a fourth cooling circuit embedded within said suction side wall, said second means comprises a fifth cooling circuit embedded within said pressure side wall, and said third means comprises an additional fluid passageway in a second one of said ribs for conducting fluid from said fourth cooling circuit to said fifth cooling circuit.

6. The turbine engine component of claim 5, further comprising said fifth cooling circuit having at least one film cooling hole for allowing cooling fluid to flow over an external surface of said pressure side wall.

7. The turbine engine component of claim 5, wherein said first cooling circuit and said fourth cooling circuit each have a fluid inlet in a root section of said turbine engine component to take advantage of pumping to increase cooling effectiveness.

8. The turbine engine component of claim 5, wherein each of said cooling circuits has a plurality of pedestals for increasing convective efficiency.

9. The turbine engine component of claim 1, further comprising a trailing edge circuit and at least one cooling hole for conducting cooling fluid from at least one of said supply cavities to said trailing edge circuit.

10. The turbine engine component of claim 1, further comprising a leading edge cooling circuit and at least one cooling hole for conducting cooling fluid from at least one of said supply cavities to said leading edge cooling circuit.

11. The turbine engine component of claim 1, wherein said turbine engine component comprises a turbine blade.

12. A process for cooling a turbine engine component comprising the steps of:

providing a first cooling circuit in a suction side of an airfoil portion of said turbine engine component;

providing a second cooling circuit in a pressure side of said airfoil portion;

convectively cooling said suction side of said airfoil portion with said first cooling circuit; and heating a rib within said airfoil portion using cooling fluid leaving said first cooling circuit, wherein said heating step comprises causing said cooling fluid from said first cooling circuit to flow through at least one passageway in said rib.

13. The process of claim 12, further comprising supplying said cooling fluid from said first cooling circuit to said second cooling circuit and ejecting said cooling fluid onto said pressure side of said airfoil via at least one film cooling hole.

14. The process of claim 13, further comprising providing a third cooling circuit in said suction side and providing a fourth cooling circuit in said pressure side and causing fluid from said third cooling circuit to flow to said fourth cooling circuit.

15. The process of claim 14, further comprising introducing said cooling fluid into each of said first and third cooling circuits via an inlet positioned at a root section of said airfoil to take advantage of pumping.

16. The process of claim 12, further comprising providing a leading edge cooling circuit and supplying cooling fluid to said leading edge cooling circuit from a first supply cavity.

17. The process of claim 12, further comprising providing a trailing edge cooling circuit and supplying cooling fluid to said trailing edge cooling circuit from a second supply cavity.

* * * * *

UNITED STATES PATENT AND TRADEMARK OFFICE

CERTIFICATE OF CORRECTION

PATENT NO. : 7,625,179 B2
APPLICATION NO. : 11/520374
DATED : December 1, 2009
INVENTOR(S) : Cunha et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 496 days.

Signed and Sealed this

Twenty-first Day of December, 2010

David J. Kappos

David J. Kappos
*Director of the United States Patent and Trademark Office*